US007595594B2

(12) United States Patent
Korobochko et al.

(10) Patent No.: US 7,595,594 B2
(45) Date of Patent: Sep. 29, 2009

(54) ARRANGEMENT FOR SWITCHING HIGH ELECTRIC CURRENTS BY A GAS DISCHARGE

(75) Inventors: Vladimir Korobochko, Goettingen (DE); Alexander Keller, Goettingen (DE); Juergen Kleinschmidt, Goettingen (DE)

(73) Assignee: XTREME technologies GmbH, Jena (DE)

( * ) Notice: Subject to any disclaimer, the term of this patent is extended or adjusted under 35 U.S.C. 154(b) by 53 days.

(21) Appl. No.: 12/041,121

(22) Filed: Mar. 3, 2008

(65) Prior Publication Data

US 2008/0265779 A1 Oct. 30, 2008

(30) Foreign Application Priority Data

Apr. 28, 2007 (DE) ..... 10 2007 020 742

(51) Int. Cl.
*H05B 31/26* (2006.01)

(52) U.S. Cl. ..... 315/111.21; 315/111.31; 315/111.91; 313/231.31; 313/539; 313/618

(58) Field of Classification Search ..... 315/111.01, 315/111.21, 111.31, 111.71, 111.91, 248; 250/504 R, 493.1; 313/231.31, 293, 326, 313/491, 539, 574, 618

See application file for complete search history.

(56) References Cited

U.S. PATENT DOCUMENTS 3,699,384 A * 10/1972 Eckhardt ..... 315/111.01
5,126,638 A 6/1992 Dethlefsen
5,399,941 A 3/1995 Grothaus et al.
5,502,356 A 3/1996 McGeoch
5,973,447 A * 10/1999 Mahoney et al. ..... 313/359.1
6,240,163 B1 5/2001 Zhang et al.
6,417,604 B1 7/2002 Hartmann et al.
6,617,806 B2 * 9/2003 Kirkpatrick et al. ..... 315/248
6,728,337 B2 4/2004 McGeoch (Continued)

FOREIGN PATENT DOCUMENTS

DE 10 2005 025 624 12/2006
EP 1 406 124 5/2004

OTHER PUBLICATIONS

Technical Physics, vol. 44 No. 6, Jun. 1999 (pp. 641-644) S. P. Nikulin "Hollow cathode glow discharge in long tubes".

*Primary Examiner*—David Hung Vu
*Assistant Examiner*—Tung X Le
(74) *Attorney, Agent, or Firm*—Reed Smith LLP

(57) ABSTRACT

The present invention is directed to an arrangement for switching high electric currents by way of a gas discharge at high voltages or for generating gas discharge plasma emitting EUV radiation. It is the object of the invention to find a novel possibility for generating a hollow cathode plasma that permits a longer life of the cathodes of short wavelength-emitting gas discharge radiation sources and pseudospark switches, also in high-power operation. This object is met in that the metal wall between the hollow cathode space and the discharge space has a thickness on the order of the centimeter range so that the openings of the metal wall change into relatively long channels and in that substantially radially extending cooling channels are introduced in the metal wall to reduce the ion erosion of the metal wall of the hollow cathode through efficient cooling.

26 Claims, 3 Drawing Sheets

U.S. PATENT DOCUMENTS 7,180,081 B2 2/2007 Walker et al.
2003/0183787 A1 10/2003 Ikeuchi
2006/0138960 A1 6/2006 Derra et al.
2007/0090304 A1* 4/2007 Jonkers et al. ..... 250/504 R

* cited by examiner

ARRANGEMENT FOR SWITCHING HIGH ELECTRIC CURRENTS BY A GAS DISCHARGE

CROSS-REFERENCE TO RELATED APPLICATION

This application claims priority of German Application No. 10 2007 020 742.7, filed Apr. 28, 2007, the complete disclosure of which is hereby incorporated by reference.

BACKGROUND OF THE INVENTION a) Field of the Invention

The present invention is directed to an arrangement for switching high electric currents by way of a gas discharge at high voltages or for generating gas discharge plasma emitting EUV radiation, comprising an anode and a cathode which are both shaped so as to be hollow in a rotationally-symmetric manner and through which a discharge space is formed in the interior of the anode, wherein the cathode has a hollow cathode space for pre-ionization of a work gas and the hollow cathode space is delimited relative to the discharge space by a metal wall with a plurality of openings for streaming pre-ionized work gas into the discharge space, these openings being arranged at regular spatial intervals. It is applied particularly in gas discharge arrangements for generating plasma that emits EUV radiation in radiation sources for semiconductor lithography and pseudospark switches.

b) Description of the Related Art

Special gas discharge arrangements for generating short-wavelength radiation are operated by electrically pulsed high-power sources. In the simplest case, they are capacitors which are charged by line voltage equipment and then discharged when an electric contact is closed by suitable switches by means of a gas discharge arrangement. Peak currents of up to 50 kA at voltages of more than 5 kV with rates of current rise greater than 1 kA/ns must be handled. Pseudospark switches which are described, e.g., in U.S. Pat. No. 6,417,604 B1, U.S. Pat. No. 5,502,356 A, U.S. Pat. No. 5,126,638 A and U.S. Pat. No. 5,399,941 A are suitable for this purpose.

Pseudospark switches are gas-filled discharge arrangements with electrodes comprising one or more discharge openings arranged in a suitable geometric manner. These openings cause directed, stable discharges. The purpose of using a plurality of discharge channels is to reduce the local current density. The gas pressure and electrode spacing are selected in such a way that the operating point lies on the left-hand side of the Paschen curve. The cathode is preferably shaped as a hollow cathode, and one or more trigger openings in an intermediate wall of the cathode make it possible to ignite a hollow cathode plasma.

By abstracting from the physical functional principle, it can be seen that the essential difference between pseudospark switches and gas discharge radiation sources merely consists in that the latter has an additional anode opening for radiation emission. Therefore, the functionality (useful life) can be prolonged in both cases of application by improving the design of the hollow cathode.

The conventional arrangements of gas discharge radiation sources and pseudospark switches have two substantial disadvantages which severely limit the life of the current-loaded electrodes:

a) The geometry of known pseudospark switches and radiation sources based on hollow cathode gas discharges does not permit a high-power cooling of the cathode. High-power operation of such switches (repetition frequencies of greater than 4 kHz) requires the dissipation of an average heat output of several tens of kW.

b) The thickness of the metal wall which separates the discharge space from the hollow cathode space is usually about 1 to 3 mm. This severely limits the life of the cathode, which is exacerbated by the poor dissipation of heat.

It is easily recognized that the cause of the short life of the cathode is the functionally important metal wall between the hollow cathode space and the main discharge space because, on one hand, it is the quickest to become worn in such a way as to impair function due to the ion erosion and, on the other hand, is simply too thin for a high-power cooling for reducing erosion. However, increasing the wall thickness, which would obviously substantially prolong the useful life of the wall against erosion, would bring about a change in the discharge behavior due to the substantial lengthening of the discharge holes in the cathode wall.

In contrast to the conventional hollow cathode structure in which the cathode wall—as described, e.g., in US2006/0138960 A1—has a plurality of uniformly arranged openings in a sieve-like manner, the attainable current strengths are diminished when the wall thickness is increased because of the relatively long through-openings so that the hollow cathode plasma no longer leads to the desired stable gas discharge in the discharge space.

OBJECT AND SUMMARY OF THE INVENTION

It is the primary object of the invention to find a novel possibility for generating a hollow cathode plasma that also permits a longer life of the cathodes of pseudospark switches and short wavelength-emitting gas discharge radiation sources in high-power operation, i.e., at a high average output of the pulsed gas discharge.

In an arrangement for switching high electric currents by way of a gas discharge for generating gas discharge plasma emitting EUV radiation, comprising an anode and a cathode which are both shaped so as to be hollow in a rotationally-symmetric manner and through which a discharge space is formed in the interior of the anode, wherein the cathode has a hollow cathode space for pre-ionization of a work gas and the hollow cathode space is delimited relative to the discharge space by a metal wall with a plurality of openings for streaming pre-ionized work gas into the discharge space which are arranged at regular spatial intervals in order to provide spatially distributed base points of gas discharge paths through the openings for a high current flow through the discharge space, the above-stated object is met according to the invention in that the metal wall between the hollow cathode space and the discharge space has a thickness on the order of one centimeter so that the openings of the metal wall change into relatively long channels and the ends of the channels are directed to the discharge space on a common intersection point (S) in the discharge space, and in that substantially radially extending cooling channels are introduced into the metal wall to reduce the ion erosion of the cathode through efficient cooling.

The openings of the channels to the discharge space are advantageously arranged in a uniformly distributed manner on at least one concentric circular line along the curved metal wall. Further, the channels in the metal wall have a consistent diameter which is substantially smaller in relation to the length of the channels at least within a portion converging at a common intersection point of the discharge space and which presents a discharge channel for orienting a plasma channel to be generated in the discharge space.

In a construction which is particularly advantageous from the view point of manufacture, the channels are formed of channel portions which are collinear and channel portions which converge in the discharge space, the collinear channel portions proceeding from the hollow cathode space and passing into converging discharge channels.

The collinear channel portions which start in the hollow cathode space advantageously have a greater diameter than the converging discharge channels, and only the converging discharge channels are formed with a defined ratio of diameter (D) and length (L). The ratio of diameter and length of the discharge channels is preferably between 0.1 and 0.15.

Further, in an arrangement for switching high electric currents by way of a gas discharge in pseudospark switches comprising an anode and a cathode which are both shaped so as to be hollow in a rotationally-symmetric manner and through which a discharge space is formed in the interior of the anode, wherein the cathode has a hollow cathode space for pre-ionization of a work gas and the hollow cathode space is delimited relative to the discharge space by a metal wall with a plurality of openings for streaming pre-ionized work gas into the discharge space which are arranged at regular spatial intervals in order to provide spatially distributed base points of gas discharge paths through the openings for a high current flow through the discharge space, the above stated object is met in that the metal wall between the hollow cathode space and the discharge space has a thickness on the order of one centimeter so that the openings of the metal wall change into relatively long channels and the ends of the channels are oriented to the discharge space in a collinear to divergent manner in order that the gas discharge paths through the channels in the discharge space are spatially distributed as strictly directed plasma channels, and in that substantially radially extending cooling channels are introduced into the metal wall to reduce the ion erosion of the metal wall of the hollow cathode through efficient cooling.

The openings of the channels to the discharge space are advisably arranged in a uniformly distributed manner on at least one concentric circular line along the curved metal wall.

At least within a defined portion presenting a discharge channel opening into the discharge space, the channels in the metal wall advantageously have a uniform diameter which is substantially smaller than the length of the channels.

When the metal wall is especially thick or when the inlet directions into the discharge space diverge, the inlet channels are advisably formed of collinear channel portions and channel portions which diverge toward the discharge space, wherein the collinear channel portions proceed from the hollow cathode space and pass into discharge channels diverging toward the discharge space. The collinear channel portions starting in the hollow cathode space have a greater diameter than the diverging discharge channels to the discharge space, and only the diverging discharge channels are formed with a defined ratio of diameter and length. The ratio of diameter and length of the discharge channels is advantageously between 0.1 and 0.15 in the uniform inlet channels as well as in the combined inlet channels.

In both of the basic arrangements for switching high electric currents by way of a gas discharge, the cooling channels are advantageously arranged centrally between the discharge channels and mutually intersect for the purpose of reducing the ion erosion of the metal wall between the hollow cathode space and the discharge space. The coolant supply and coolant outlet are formed so as to be located opposite one another in a semicircular shape.

For this purpose, the coolant supply and the coolant outlet are preferably formed as oppositely located grooves which are recessed into the rear end face of the cathode along a cylinder surface area.

Each of the channels for streaming in work gas is advantageously enclosed by cooling channels which are arranged symmetrically in pairs, and all of the center axes of such coolant channel pairs intersect in the axis of symmetry of the hollow cathode. The cooling channels of a cooling channel pair are preferably introduced into the metal wall parallel to one another.

The cathode is advisably made of a high-melting metal, preferably tungsten or molybdenum.

But the cathode can also advantageously be composed of a cathode base body and an electrode collar, wherein only the electrode collar comprises the high-melting metal and the cathode base body is made of a metal with high thermal conductivity, preferably copper or a copper alloy. The boundary between the metal with high thermal conductivity and the high-melting metal advisably extends within the metal wall of the cathode. The cooling channels can be arranged inside the cathode collar as well as inside the cathode base body.

The invention makes it possible to realize an arrangement for generating a hollow cathode plasma which permits a comparatively long life of the cathodes of short wavelength-emitting gas discharge radiation sources and pseudospark switches also in high-power operation, i.e., at a high average output of the gas discharge that is generated in a pulsed manner.

The invention will be described more fully in the following with reference to embodiment examples.

DESCRIPTION OF THE PREFERRED EMBODIMENTS

Figure 1:
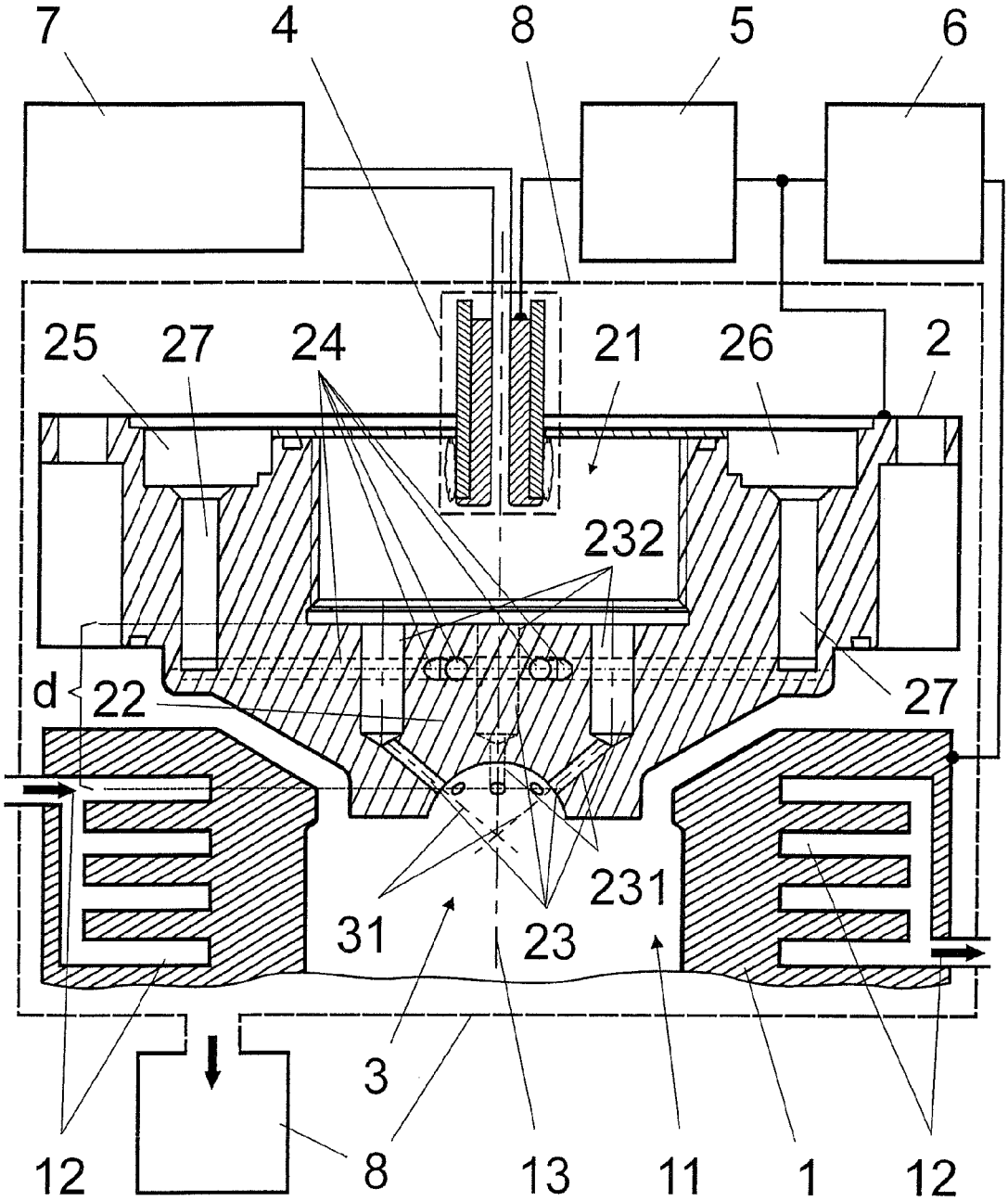
FIG. 1 shows a schematic view of the arrangement according to the invention in which the wall between the hollow cathode space and main discharge space is appreciably thicker in order to receive a cooling system.

As is shown in FIG. 1, the arrangement for switching high electric currents, which is suitable for high-power current switching or for generating EUV radiation, has an anode 1, which surrounds an anode interior 11 in a rotationally symmetric manner and is temperature-regulated in a conventional manner by an anode cooling system 12, and a cathode in the form of a hollow cathode 2. The hollow cathode space 21 is separated by a metal wall 22 from a discharge space 3 formed in the anode interior 11. The metal wall 22 has a thickness in the centimeter range (preferably in the range of ≧1 cm) and is made of a high-melting material such as, e.g., tungsten or molybdenum, in view of the high thermal loading (at least at the surface facing the discharge space 3).

The gas discharge arrangement is peripherally connected to a pre-ionization unit 4 which is arranged in the hollow cathode space 21 of the hollow cathode 2, a pre-ionization generator 5, and a main discharge pulse generator 6. A gas supply unit 7 provides for the supply of a work gas to the hollow cathode space 21, preferably via the pre-ionization unit 4, and a vacuum system 8 provides a sufficient vacuum at least for the discharge space 3 or also for the environment of the entire electrode arrangement.

Inlet channels 23 from the hollow cathode space 21 to the discharge space 3 are provided in the metal wall 22 for streaming in work gas that is ionized in the hollow cathode space 21 and are arranged in the metal wall 22 so as to be uniformly distributed, preferably symmetrically around the axis of symmetry 13, in order to provide the most symmetric possible distribution of the base points F for current to exit from the hollow cathode 2 into the discharge space 3 during the main discharge inside the discharge space 3.

For an optimal discharge in the discharge space 3 in which plasma channels 31 are formed from ionized work gas streaming in a directed manner, a determinately small ratio of diameter D and length L of about 0.1 to 0.15 is adjusted at least in some portion of the inlet channels 23 provided in the metal wall 22. This dimensioning of the inlet channels 23 must be maintained obligatorily only for the portion of the channel which, as discharge channel 231, determines the respective flow-out direction of the ionized work gas in the discharge space 2 and through which the (incipient) gas discharge initialized therein predetermines the forming of the directed "plasma channels" 31 in the discharge space. That is, the ratio of the dimensions D and L only concerns the (portion of the) discharge channel 231 oriented in the discharge space 3. The "thicker" collinear input portions 232 of the inlet channels 23 (preferably constructed as collinear bore holes) which start in the hollow cathode space are to be attributed to the hollow cathode space 21 in terms of function. These input portions 232 are designed at the appropriate locations for connecting the hollow cathode space 21 to the discharge channels 231 so that—given a fixed position and length L of the discharge channels 231—the metal wall 22 can be constructed with any thickness (e.g., also >1 cm) for introducing the cooling lines 24.

With a thickness d in the centimeter range, the metal wall 22 constructed in this way between the hollow cathode space 21 and discharge space 3 substantially increases the usable life against erosion caused by ions occurring during the main discharge and has the advantage that suitable cooling channel geometries can be introduced into a metal wall 22 which allow metal wall thicknesses of 3 cm that successfully reduce erosion in continuous operation. According to the invention, the wall openings that are conventional in the prior art change into channels 23 of varying length depending on the thickness of the metal wall 22.

The primary aim of designing the metal wall 22 between the discharge space 3 and the hollow cathode space 21 to be thicker is to make available sufficient material for a known erosion rate (⊔1 g cathode material/$10^8$ discharges). But at the same time this step can provide a previously unavailable material thickness for a direct cooling through cooling channels 24 inside the metal wall 22. However, initial experiments with this hollow cathode shape with a thick metal wall 22 exhibited an appreciably reduced current flow through the discharge space 3.

Surprisingly, it was found that the cause of this was that the discharge channels 23 in the metal wall 22 of the hollow cathode 2 behave like individual tubular hollow cathodes without an intermediate wall and with a surface anode arranged at the front. For the latter configuration, NIKULIN (e.g., Tech. Phys. 44 6 (1999) 641) published the findings of extensive basic experiments in which a determined ratio of diameter and length of a tubular cathode shape was indicated as the condition for an optimal discharge behavior.

With respect to the cathode shape according to the invention, it was proven that a different type of discharge takes place within the discharge space 3 for hollow cathodes 2 having an intermediate metal wall 22 when this metal wall 22 is constructed with a thickness d in the centimeter range, this discharge type changing from a discharge shape which is spatially distributed (through defined base points F at the openings in the metal wall 22) to a defined quantity of stable, strictly oriented channel discharges (plasma channels 31) of long tubular hollow cathodes (without an intermediate wall) which must be considered separately. Based on the tube dimensioning indicated by NIKULIN for the "free hollow cathode", a way was found to adapt the discharge conditions to a hollow cathode plasma generated through long inlet channels 23 in which a high (pulsed) current flow via a defined quantity of very stably forming plasma channels 31 is achieved within the discharge space 3 by precise spatial orientation of discharge channels 231 having defined dimensions.

Without loss of generality—particularly because of a diverging construction in pseudospark switches (see FIG. 3)—the determinately dimensioned portions of the inlet channels 23, i.e., the discharge channels 231, are directed to a common intersection point S in an arrangement for generating EUV radiation in FIG. 1 in order that the plasma which contracts during the discharge as a result of the current-induced magnetic field formation is focused for a high radiation yield in the spectral region of soft x-ray radiation (EUV) from the start. (For pseudospark switches, the principal goal at this point is a broad spatial distribution in the discharge space 3 according to FIG. 3 in order to minimize the thermal heating).

In an electrode arrangement according to FIG. 1, the ratio between diameter D and length L of the discharge channels 231 for plasma generation at intersection point S of the discharge space 3 can be optimized both with and without the pre-ionization unit 4 in the hollow cathode space 21.

To generate the dense, hot (radiating) plasma—as is shown in FIG. 1—the inlet channels 23 are bent out so as to direct them to the common intersection point S in the axis of symmetry 13 of the discharge space 3. Consequently, they are formed of different portions, a collinear portion 232 being formed (preferably drilled) from the hollow cathode space 21 into the metal wall 22 parallel to the axis of symmetry 13 and a converging portion, serving as discharge channel 231, being oriented to the common intersection point S of all of the discharge channels 231 in the discharge space 3.

Figure 2:
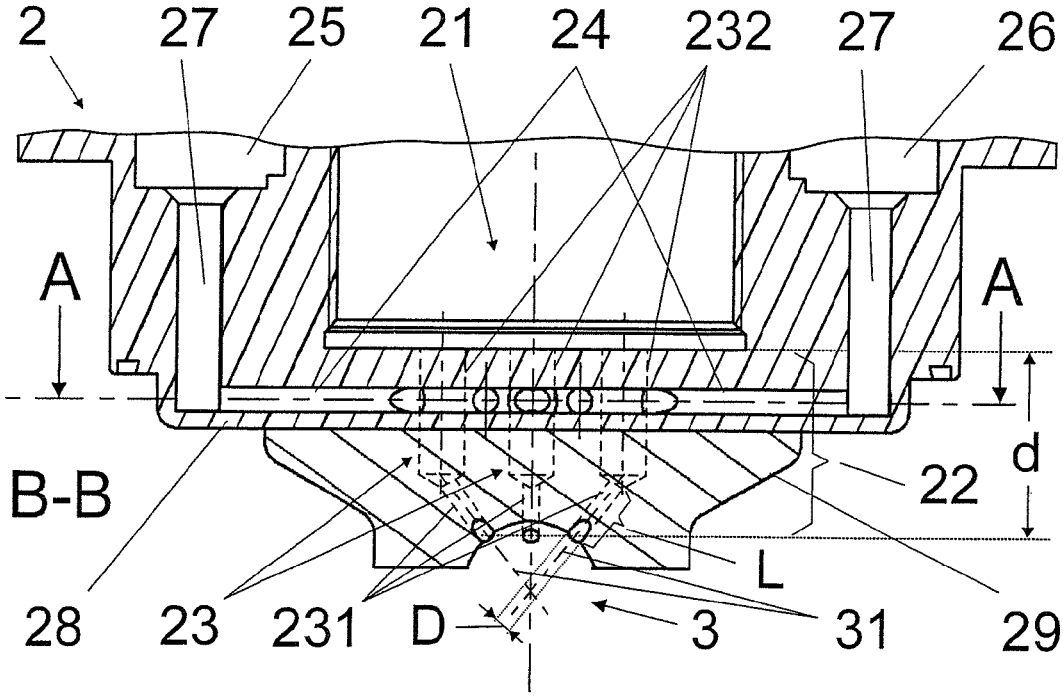
FIG. 2 shows a special construction of the cooling system of the hollow cathode with intersecting parallel double-channels in cross section (A-A) through the intermediate wall of the hollow cathode and in axial section (B-B) through the hollow cathode.
Figure 2:
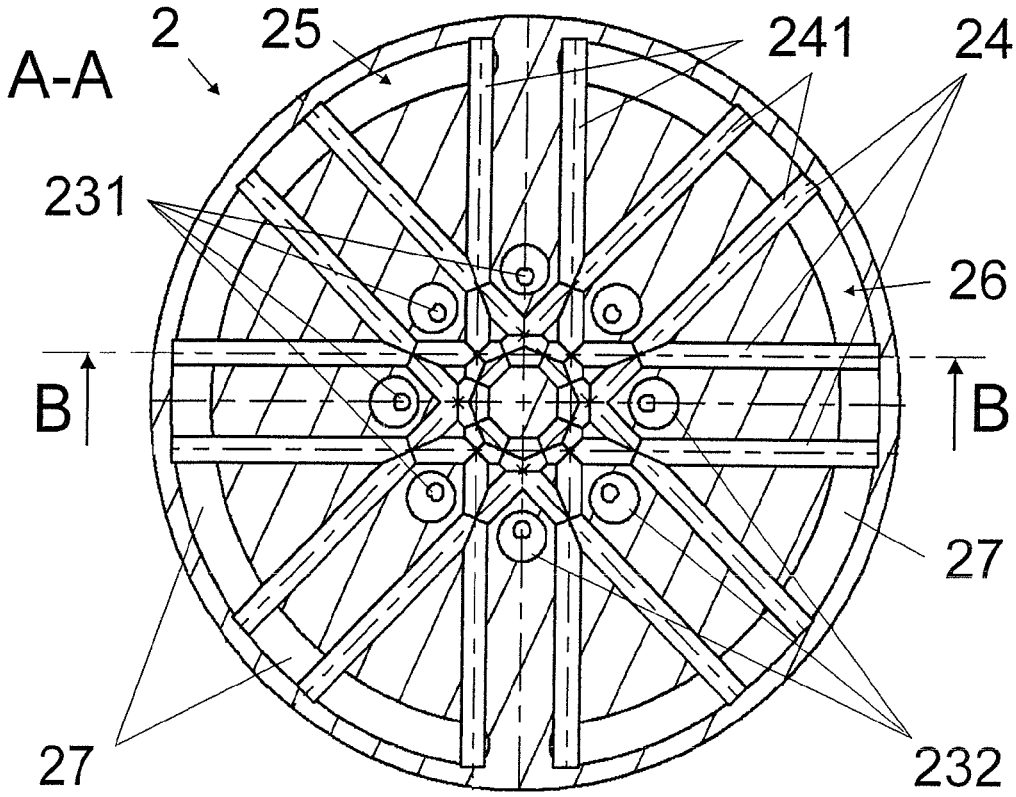

As can be seen particularly clearly in the bottom part of FIG. 2 from the cross-sectional view through the hollow cathode 2 along plane A-A, cooling channels 24 for reducing the ion erosion of the metal wall 22 are arranged in the center between the inlet channels 23 which are arranged so as to be uniformly distributed (preferably on a circular line) around the axis of symmetry 13.

In a particularly advantageous construction which is shown in FIG. 2 in the bottom cross-sectional view (along plane A-A of the upper axial section B-B), the cooling channels 24 are parallel to one another in pairs and enclose an inlet channel 23, respectively, along their center line. The parallel pair of cooling channels 24 arranged in this way intersect a number of times, first between the inlet channels 23 and then within the circle formed by the inlet channels 23, so that a maze of intersecting portions of the cooling channels 24 is formed inside the circle of the inlet channels 23.

Regardless of whether or not the cooling channels 24 cross or intersect one another as parallel pairs within a plane or in different planes (not shown) or extend as individual cooling channels 24 (FIG. 3) crossing, e,g., in the axis of symmetry 13, between the inlet channels 23, the cooling channels 24 are substantially radially oriented and are connected at the periphery of the hollow cathode 2 to a semi-circular coolant supply 25 and a semicircular coolant outlet 25 which lie symmetrically opposite from one another.

In the special construction according to FIG. 2, the coolant supply 25 is connected by a cylindrically-shaped connection groove 27 to one end of the cooling channels 24, and the coolant outlet 26 is connected to its other end by a cylindrically-shaped connection groove 27 which is located opposite from it symmetric to the axis of symmetry 13. The connection groove 27 is preferably cut into the hollow cathode 2 from the back side.

Figure 3:
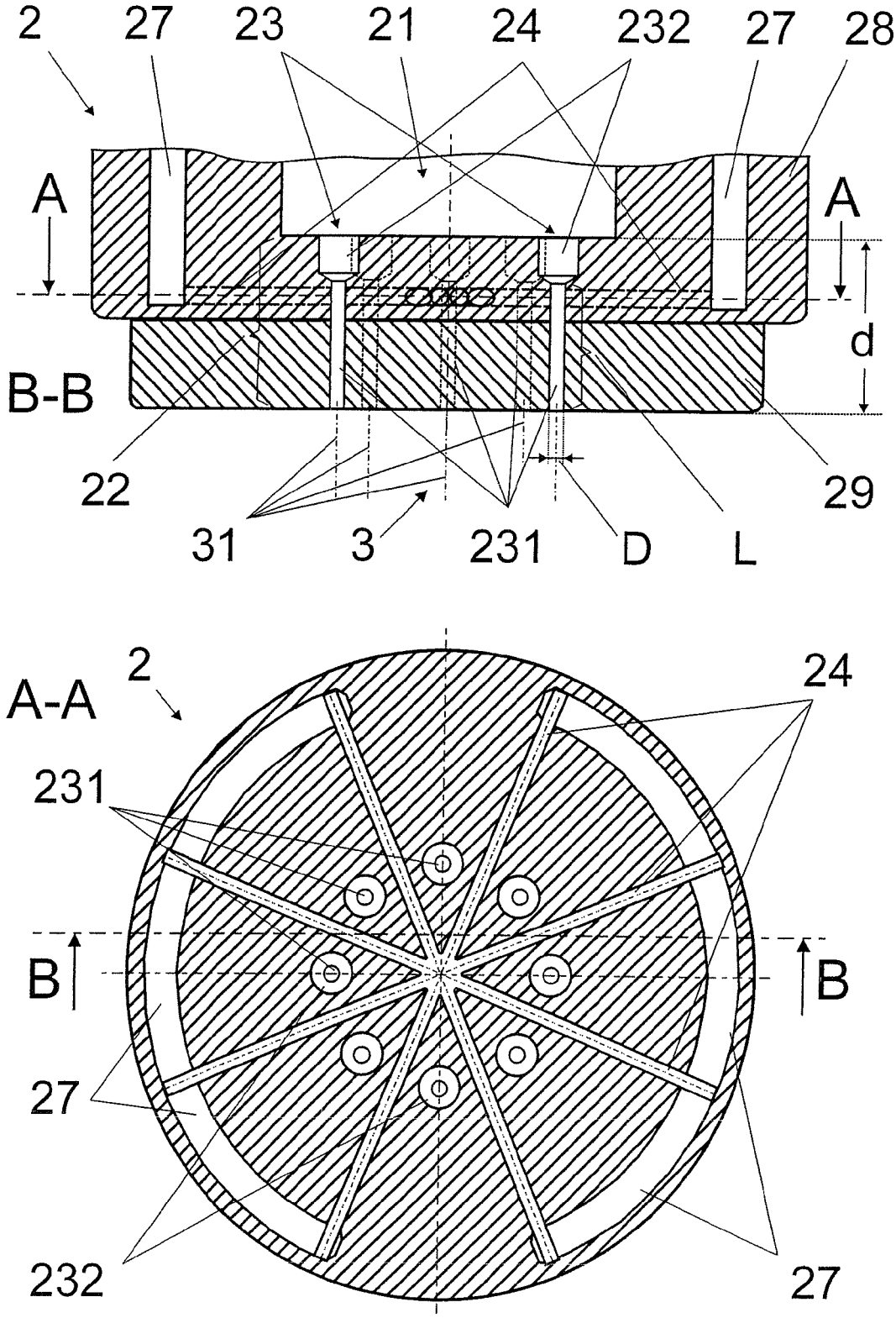
FIG. 3 shows a construction of the invention as a pseudospark switch with simplified cooling channel system analogous to FIG. 2.

An alternative variant for introducing the cooling channels 24 as intersecting individual channels—as is shown at bottom in FIG. 3 for the construction of a pseudospark switch—can be used in an equivalent manner for the hollow cathode 2 shown at the top in FIG. 2.

In order to improve the cooling power, the hollow cathode 2 can be composed of two different materials, a cathode base body 28 and a cathode collar 29 as is shown in axial section at top in FIG. 2. The electrode collar 29, which is the current outlet surface of the hollow cathode 2 to the discharge space 3, is manufactured from a high-melting material (e.g., tungsten, molybdenum, etc.) and the cathode body 28 which is preferably fixedly connected to the cathode collar 29 by the manufacturing technique of back-casting, is produced from a very highly heat-conducting material (e.g., copper, silver, etc., or alloys thereof).

The cooling channels 24 advisably extend inside the cathode base body 28, but can also be introduced (preferably additionally) in the cathode collar 29.

FIG. 3 shows a construction of the invention as a pseudospark switch. All of the fundamental principles and constructions according to FIGS. 1 and 2, with the exception of the open anode shape and the plasma channels 31 intersecting in the discharge space 3, apply in this case. In this case, the anode 1 is designed so as to be closed and can be constructed in a pot-shaped manner.

In this case, the inlet channels 23 of the hollow cathode space 21 to the discharge space 3 do not need to be divided into collinear portions and converging portions, but rather are discharge channels 231 considered as a whole, since a concentrated hot (radiating) plasma column need not be generated. The discharge channels are preferably constructed so as to diverge or—as is shown at top in FIG. 3—in a collinear manner. For a divergent orientation, however, it may be necessary to provide "thicker" collinear input portions 232 in the metal wall 22 so as to adjust the required ratios of diameter D and length L of the discharge channels 231 proceeding from this metal wall 22 so as to curve outward. A corresponding curvature of the metal wall 22 must also be provided in this case.

While the foregoing description and drawings represent the present invention, it will be obvious to those skilled in the art that various changes may be made therein without departing from the true spirit and scope of the present invention.

REFERENCE NUMBERS

1 anode
11 anode interior
12 anode cooling system
13 axis of symmetry
2 hollow cathode
21 hollow cathode space
22 metal wall
23 discharge channel
24 cooling channel
25 coolant supply
26 coolant outlet
27 connection groove
28 cathode base body
29 cathode collar
3 discharge space
31 plasma channel
4 pre-ionization unit
5 pre-ionization pulse generator
6 main discharge pulse generator
7 gas supply unit
8 vacuum system
F base point
d thickness (of the metal wall)
D diameter (of the discharge channel)
L length (of the discharge channel)
S (common) intersection point

What is claimed is:

1. An arrangement for switching high electric currents by way of a gas discharge for generating gas discharge plasma emitting EUV radiation, comprising:

an anode and a cathode which are both shaped so as to be hollow in a rotationally-symmetric manner and through which a discharge space is formed in the interior of the anode;

said cathode having a hollow cathode space for pre-ionization of a work gas and the hollow cathode space is delimited relative to the discharge space by a metal wall with a plurality of openings for streaming pre-ionized work gas into the discharge space which are arranged at regular spatial intervals in order to provide spatially distributed base points of gas discharge paths through the openings for a high current flow through the discharge space;

said metal wall between the hollow cathode space and the discharge space having a thickness on the order of one centimeter so that the openings of the metal wall change into relatively long channels and the ends of the channels are directed to the discharge space on a common intersection point in the discharge space; and substantially radially extending cooling channels being introduced into the metal wall to reduce an ion erosion of the cathode through efficient cooling.

2. The arrangement according to claim 1, wherein the openings of the channels to the discharge space are arranged in a uniformly distributed manner on at least one concentric circular line along the curved metal wall.

3. The arrangement according to claim 1, wherein the channels in the metal wall have a consistent diameter which is substantially smaller in relation to the length of the channels at least within a portion converging at a common intersection point which presents a discharge channel which opens into the discharge space.

4. The arrangement according to claim 3, wherein the channels are formed of channel portions which are collinear and channel portions which converge in the discharge space, wherein the collinear channel portions proceed from the hollow cathode space and pass into converging discharge channels.

5. The arrangement according to claim 4, wherein the collinear channel portions which start in the hollow cathode space have a greater diameter than the converging discharge channels to the discharge space, wherein only the converging discharge channels are formed with a defined ratio of diameter and length.

6. The arrangement according to claim 5, wherein the ratio of diameter and length of the discharge channels is between 0.1 and 0.15.

7. The arrangement according to claim 3, wherein the ratio of diameter and length of the discharge channels is between 0.1 and 0.15.

8. The arrangement according to claim 1, wherein the cooling channels are arranged centrally between the channels and mutually intersect, wherein the coolant supply and the coolant outlet are formed so as to be located opposite one another in a semicircular shape.

9. The arrangement according to claim 8, wherein the coolant supply and the coolant outlet are formed as oppositely located grooves which are removed from the rear end face of the cathode along a cylinder surface area.

10. The arrangement according to claim 8, wherein each channel for streaming in the ionized work gas is enclosed by cooling channels which are arranged symmetrically in pairs, wherein all of the center axes of such coolant channel pairs intersect in the axis of symmetry of the hollow cathode.

11. The arrangement according to claim 1, wherein the hollow cathode is made of a high-melting metal.

12. The arrangement according to claim 11, wherein the hollow cathode is made of tungsten or molybdenum.

13. The arrangement according to claim 11, wherein the hollow cathode comprises a cathode base body and an electrode collar, wherein only the electrode collar is made of the high-melting metal, and the cathode base body is made of a metal with high thermal conductivity.

14. The arrangement according to claim 13, wherein the cathode base body is made of copper or a copper alloy.

15. The arrangement according to claim 13, wherein the boundary between the highly thermally conducting cathode base body and the high-melting electrode collar is arranged within the metal wall of the hollow cathode.

16. The arrangement according to claim 13, wherein the cooling channels are arranged inside the cathode collar.

17. The arrangement according to claim 13, wherein the cooling channels are arranged inside the cathode base body.

18. An arrangement for switching high electric currents by way of a gas discharge in pseudospark switches, comprising:

an anode and a cathode, both of which are shaped so as to be hollow in a rotationally-symmetric manner and through which a discharge space is formed in the interior of the anode;

said cathode having a hollow cathode space for the pre-ionization of a work gas and the hollow cathode space is delimited relative to the discharge space by a metal wall with a plurality of openings for streaming pre-ionized work gas into the discharge space which are arranged at regular spatial intervals in order to provide spatially distributed base points of gas discharge paths through the openings for a high current flow through the discharge space;

said metal wall between the hollow cathode space and the discharge space having a thickness on the order of one centimeter so that the openings of the metal wall change into relatively long channels and the ends of the channels are oriented to the discharge space in a collinear to divergent manner in order that the gas discharge paths through the channels in the discharge space are spatially distributed as strictly directed plasma channels; and substantially radially extending cooling channels being introduced in the metal wall to reduce the ion erosion of the metal wall of the hollow cathode through efficient cooling.

19. The arrangement according to claim 18, wherein the openings of the channels to the discharge space are arranged in a uniformly distributed manner on at least one concentric circular line along the curved metal wall.

20. The arrangement according to claim 18, wherein at least within a defined portion presenting a discharge channel opening into the discharge space, the channels in the metal wall have a uniform diameter which is substantially smaller than the length of the channels.

21. The arrangement according to claim 18, wherein the channels are formed of collinear channel portions and channel portions which diverge in the discharge space, wherein the collinear channel portions proceed from the hollow cathode space and pass into discharge channels diverging toward the discharge space.

22. The arrangement according to claim 21, wherein the collinear channel portions starting in the hollow cathode space have a greater diameter than the diverging discharge channels to the discharge space, wherein only the diverging discharge channels are formed with a defined ratio of diameter and length.

23. The arrangement according to claim 22, wherein the ratio of diameter and length of the discharge channels is between 0.1 and 0.15.

24. The arrangement according to claim 21, wherein the ratio of diameter and length of the discharge channels is between 0.1 and 0.15.

25. The arrangement according to claim 18, wherein the cooling channels are arranged centrally between the channels and mutually intersect, wherein the coolant supply and the coolant outlet are formed so as to be located opposite one another in a semicircular shape.

26. The arrangement according to claim 18, wherein the hollow cathode is made of a high-melting metal.

* * * * *